US005606397A

United States Patent [19]

Honda et al.

[11] Patent Number: 5,606,397

[45] Date of Patent: Feb. 25, 1997

[54] DEVELOPING UNIT FOR DEVELOPING A LATENT IMAGE FORMED ON AN IMAGE CARRIER BY CONTACTING A THIN LAYER OF TONER

[75] Inventors: Toshirou Honda, Mishima; Shigeru Fujiwara, Yokohama; Minoru Tezuka, Kawasaki, all of Japan

[73] Assignee: Kabushiki Kaisha TEC, Tokyo, Japan

[21] Appl. No.: 504,735

[22] Filed: Jul. 19, 1995

[30] Foreign Application Priority Data

Jul. 21, 1994 [JP] Japan ..... 6-169269

[51] Int. Cl.[6] ..... G03G 15/06

[52] U.S. Cl. ..... 399/98; 399/222; 399/279

[58] Field of Search ..... 355/245, 259, 355/215; 118/653

[56] References Cited

U.S. PATENT DOCUMENTS

| | | | |
|---|---|---|---|
| 5,073,797 | 12/1991 | Ono et al. | 355/215 |
| 5,191,170 | 3/1993 | Yoshida et al. | 355/245 X |
| 5,210,575 | 5/1993 | Kikuchi | 355/259 |
| 5,212,521 | 5/1993 | Ogawa et al. | 355/215 |
| 5,324,884 | 6/1994 | Honda et al. | 355/259 X |

FOREIGN PATENT DOCUMENTS

| | | |
|---|---|---|
| 61-137173 | 6/1986 | Japan . |
| 61-267771 | 11/1986 | Japan . |
| 2-26228 | 6/1990 | Japan . |
| 4-62391 | 10/1992 | Japan . |

*Primary Examiner*—Arthur T. Grimley
*Assistant Examiner*—Sophia S. Chen
*Attorney, Agent, or Firm*—Frishauf, Holtz, Goodman, Langer & Chick

[57] ABSTRACT

A developing unit having a pair of semicircular first sealing members longitudinally formed on a cylindrical portion of both ends of a toner conveying roller along an outer peripheral surface of a toner conveying roller such that a gap is set between the sealing members and a toner layer thickness determining plate in a frictional state. A pair of second sealing members are provided close to a position where the toner layer thickness determining plate faces the roller and at a position, opposite to a side facing the toner conveying roller. Each of the first and second sealing members applies predetermined pressure to the toner conveying roller, and each of the sealing members includes lubricating fine grains.

10 Claims, 5 Drawing Sheets

DEVELOPING UNIT FOR DEVELOPING A LATENT IMAGE FORMED ON AN IMAGE CARRIER BY CONTACTING A THIN LAYER OF TONER

BACKGROUND OF THE INVENTION

1. Field of the Invention

The present invention relates to a developing unit for developing a latent image formed on a photosensitive member in an image forming apparatus use in an electrostatic photographic process, and more particularly to a one component developing system which visualizes a latent image of a photosensitive member by bringing a thin layer of developer into contact with the photosensitive member.

2. Description of the Related Art

In an image forming apparatus, for example, an electrostatic copy machine, a latent image, which is obtained by applying illumination to an image of a document to correspond to reflected light from the document, is formed on a photosensitive member, which is charged to a predetermined polarity in advance. The latent image formed on the photosensitive member is developed with toner supplied from a developing unit to serve as a toner image. Thereafter, the toner image is transferred to a sheet paper provided on a surface of the photosensitive member to serve as a copy image. The toner image transferred onto the sheet paper is separated from the photosensitive member together with the sheet paper, and fixed to the sheet paper by a fixing unit. At this time, toner is melted by heat of a heater roller and is pressurized by press of the heater roller of the fixing unit. Melted toner is introduced between the fibers of the sheet paper and toner, so that the sheet paper and toner are firmly adhered to each other to be discharged as a copying output.

In recent years, as compared with the two-component developing system, the developing unit of one-component developing system has been widely used in a printer. The reason can be considered as follows.

More specifically, mixture with toner and carrier and stirring, and management of toner concentration in developer, i.e., mixing agent of carrier and toner are not needed. Replacement of developer with new one is not needed, and a size of the developing unit can be miniaturized.

As a developing unit of one component developing system, there are known a developing unit using magnetic toner and a developing unit using non-magnetic toner. However, a uniform thin layer of toner is formed on the surface (outer peripheral surface) of a developing roller by a toner restricting member regardless of the, kinds of toner.

One reason why the thin layer of toner must be formed on the developing roller is that toner supplied to the photosensitive member from the developing unit is transferred without fail. In other words, magnetic force of one component magnetic toner is smaller than that of two component developer (the size of the well-known magnetic brush is small), and is transferred by only magnetic constraint of toner. Also, one component non-magnetic toner cannot use a well-known magnetic brush, and is transferred by only electrical charge (optical antipode force), which toner has, and/or Coulomb's force by frictional electrification. Due to this, the distance between the developing roller and the photosensitive member must be narrowed as compared with the case of two component developing system.

The other reason why the thin layer of toner must be formed on the developing roller is that toner must be uniformly charged. In order to form the thin layer of toner, the following methods can be used.

A toner restricting member is brought into contact with the developing roller. Further, a toner layer thickness rusticating gap between the toner restricting member and the developing roller is narrowed.

As a result, toner is charged by the developing roller and the toner restricting member and/or frictional electrification caused by friction of toner.

However, in the developing unit of the one component non-magnetic developing system, because of centrifugal force, which is caused when the developing roller or the stirring member are rotated, impact, which is generated by friction between toner and toner thin layer forming means, or non-magnetic chain caused by non-magnetism (binding force of toner is small), toner splashes in the housing of the developing unit, and toner is leaked from the developing roller and both ends of the toner restricting member.

In order to solve these problems, a sealing member such as a teflon felt or an elastic member of urethane foam is provided on the developing roller and a side peripherary portion of both ends of the toner restricting member, thereby preventing toner from being splashed.

However, due to the long period of use of the unit, toner is introduced between fibers or into an interior of a cell, and the fibers or the interior of the cell is saturated with toner. As a result, it is known that a sealing function is considerably lowered. Therefore, in one component non-magnetic developing unit, there are problems in that means for providing a surely sealing mechanism must be prepared, a life of the sealing member used in the sealing mechanism must be considered.

FIGS. 9 and 10 are schematic views of the one component non-magnetic developing unit, seen from a direction where the developing roller is opposite to the photosensitive member.

In FIG. 9, a width W1 of a toner restricting member b is formed to be shorter than a width W2 of a developing roller a. Sealing members c serve as both side seals of toner restricting member b and the developing roller a. Also, the sealing members are provided in the side frames so as to enclose the surroundings of both ends of the developing roller a. A recovery blade e for receiving dropped toner is provided at a position corresponding to a lower stream of the toner restricting member b along the direction where the developing roller a is rotated.

In the developing unit of FIG. 9, if the width W1 of the toner restricting member b is formed to be shorter than the width W2 of the developing roller a (W1<W2) and toner shown by f is leaked from the sealing members c to an area, which is shown by widths W3 of both sides of the toner restricting member b, uncharged toner, which is not frictional between toner and the toner restricting member b, is transferred from the developing roller a. In this case, since toner f' does not obtain sufficient electrical charges, which are necessary for development, toner f' is generally adhered to a non-image sections of both end portions of the photosensitive member formed to be longer than an axial length of the developing roller a. This does not have an unfavorable influence on an image to be output since the area is out of the image area. However, since non-image section of the both end portions of the photosensitive member are always developed, there are problems in that an amount of toner consumption and an amount of toner collection are increased.

FIG. 10 shows an example in which the width W1 of the toner restricting member b is formed to be longer than the width W2 of the developing roller a (W1>W2).

At both end portions of the developing roller a, sealing members c, which are formed of non-rotatable members having the same diameter as the developing roller a, are formed to be sandwiched between side frames d. In FIG. 10, there is shown an example in which lubricating seals g having the same diameter as the developing roller a are provided in the respective spacer h between the developing roller a and sealing members c.

In the developing unit of FIG. 10, since the width W1 of the toner restricting member b is formed to be longer than the width W2 of the developing roller a, there can be solved the problem of the developing unit of FIG. 9, that is, a phenomenon in which uncharged toner f' is adhered to the photosensitive member.

However, it is substantially difficult to completely remove slight step difference between the developing roller a and the lubricating seals g and a slight step difference between the lubricating seals g and the sealing members c, toner f is splashed to an area shown by W4 of both end portions. Also, there is a problem in which the thickness of the toner layer becomes unequal at a pair of boundary lines, which is shown by the drawing.

SUMMARY OF THE INVENTION

An object of the present invention is to provide a developing unit, which is capable of forming a toner layer having a uniform thickness on a developing roller without changing the number of rotations of the developing roller.

Another object of the present invention is to provide a structure for preventing toner from being leaked from a cylindrical surface of longitudinal both ends of a developing roller to a photosensitive member.

Further, another object of the present invention is to provide sealing elements which are capable of sealing a gap between a developing roller and a toner restricting member without fail, and the structure therefor.

According to the present invention, there is provided a developing unit for developing a latent image formed on an image carrier to contact a thin layer of toner comprising: a housing member having a developer containing section for containing the toner; a toner conveying roller, rotatably provided in the housing member to face to a developing area of the image carrier, for conveying the toner to the developing area of the image carrier; a toner layer thickness determining member, having a toner layer thickness determining-plate formed to have the same length as the toner conveying roller, for forming a toner layer having a predetermined thickness made of the toner thereon by pressurizing the toner thickness determining plate onto a surface of the toner conveying roller; and a pair of sealing members longitudinally formed on a cylindrical portion of both ends of the toner conveying roller along an outer peripheral surface of the toner conveying roller to be semicircular, and to set a gap between the sealing members and the toner layer thickness determining member in a frictional state.

Moreover, according to the developing unit of the present invention, a restricting member of a developing unit is formed to be the same as the width of the developing roller, and the seal members are provided to be pressurized to contact the semicircular section of the developing roller of the upper stream side of the developing roller rotating direction than the contact line of the restricting member. Thereby, toner can be prevented from being leaked to the surface of the developing roller of a non-image area.

Further, according to the developing unit of the present invention, a frictional resistance between the seal members and the developing roller is reduced, heating caused by the developing roller or the rotational speed of the developing roller can be prevented.

Furthermore, according to the developing unit of the present invention, the second seals are set to the rear surface of both end portions. Thereby, predetermined pressure is applied to the restricting member. At the same time, toner can be prevented from being leaked to the end portion of the roller.

Therefore, both end portions of the restricting member can be correctly brought into contact with the developing roller without having influence of the warp of the restricting member or torsion, and the stable toner layer can be formed.

Additional objects and advantages of the invention will be set forth in the description which follows, and in part will be obvious from the description, or may be learned by practice of the invention. The objects and advantages of the invention may be realized and obtained by means: of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

An embodiment of the present invention will be explained with reference to the drawings.

Figure 1:
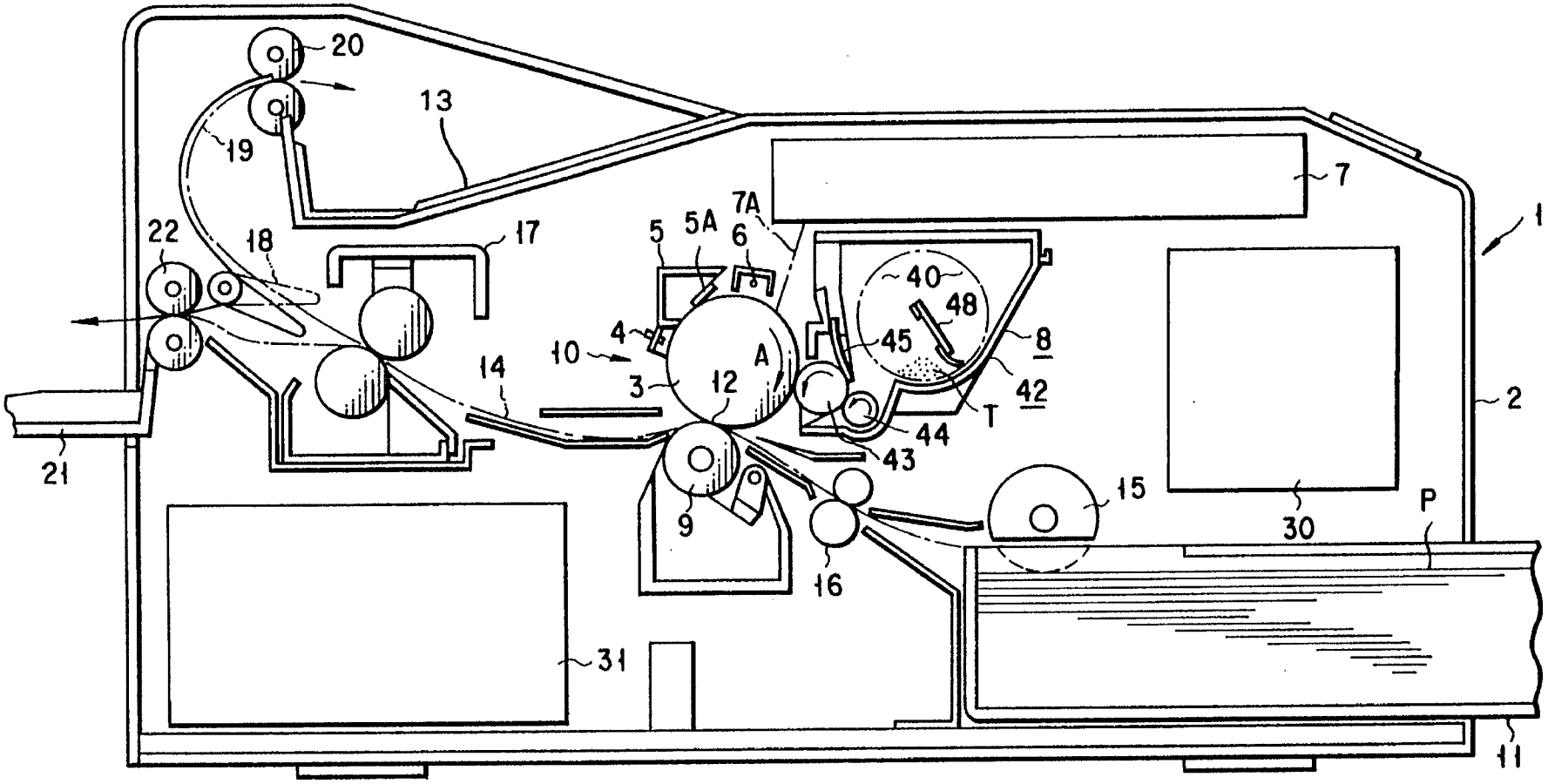
FIG. 1 is a schematic cross sectional view of an image forming apparatus into which a developing unit of an embodiment of the present invention is incorporated.

FIG. 1 is a schematic cross sectional view of an image forming apparatus into which a developing unit of an embodiment of the present invention is incorporated.

A shown in FIG. 1, an image forming apparatus 1 has a housing 2. A drum shaped organic photosensitive drum (hereinafter called as photosensitive drum) 3 is provided at substantially a central portion of the housing 2 to be rotatable in a direction of an arrow shown by A.

An LED array 4 for discharging charge on the photosensitive drum 3, a cleaning unit 5 to clean the surface of the drum 3, a charging unit 6 for charging the drum 3, a laser exposing unit 7 to form an electrostatic latent image on the drum 3, a developing unit 8 for developing the latent image and for forming a toner image by toner on the drum 3, and a transfer roller 9 to separate the toner image TI from the drum 3 to a sheet paper are sequentially provided around the photosensitive drum 3. The photosensitive drum 3, the LED array 4, the cleaning unit 5, the charging unit 6, the laser exposing unit 7, the developing unit, and the transferring roller 9 constitute a process unit 10 for forming a toner image TI corresponding to image data to be outputted.

In the housing 2, a sheet paper receiving section 13 is provided in the direction where the toner image TI is moved by rotating the photosensitive drum 3 and a direction where sheet paper P to which the toner image TI is transferred by a transfer section 12 is moved. The sheet paper receiving section 13 holds a surface on which an image is formed such that image data, which is outputted from in order of data of page 1, is superimposed on each other from page 1 in a state that the sheet paper receiving section 13 is directed to the photosensitive drum 3.

Also, in the housing 2, there is provided a sheet paper carrying passage 14 for guiding sheet paper P, picked up from a sheet paper supply cassette 11, to the sheet paper receiving section 13 through the transfer section 12.

A pair of aligning rollers 16 is provided at the upper stream side of the transfer section 12 of the sheet paper carrying passage 14. In a case where sheet paper P picked up from the sheet paper supply cassette 11 through a sheet paper feeding roller 15 is inclined to a direction where the sheet paper is carried, the aligning rollers 16 remove the inclination, and conform the head of the toner image TI (shown in FIG. 2), which is formed on the photosensitive drum 3 by the laser exposing unit 7 and developed by the developing unit 8, to the head of the sheet paper P.

At the lower stream of the transfer section 12, there are provided a fixing unit 17 for fixing the toner image TI transferred to sheet paper P, a switching gate 18 for guiding fixed sheet paper P to the sheet paper receiving section 13 and a discharge tray 21.

Sheet papers P directed to the sheet paper receiving section 13 are transported through a reverse carrying passage 19 and a first pair of discharging rollers 20. Alternatively, the sheet papers P guided to the discharge tray 21 are discharged from the housing 2 by a second pair of discharge rollers 22.

Also, a controlling section 30 for controlling an operation of the entire apparatus is provided at a predetermined position of the housing 2, for example, a position where influence of heat generated by the fixing unit 17 is not easily exerted. Moreover, power supply unit 31 is provided at a predetermined position of a relatively bottom portion of the housing 2.

The following will explain an operation of the image forming of the image forming apparatus 1 with reference to FIG. 1.

The photosensitive drum 3 is rotated in a direction of an arrow A at a predetermined process speed, and a predetermined voltage is applied to the charging unit 6, thereby a predetermined electrical charge is supplied onto the surface of the photosensitive drum 3. In other words, the surface of the photosensitive drum 3 is charged at a predetermined polarity and a predetermined potential by the high voltage discharging from the charge unit 6.

Next, by the laser exposing unit 7, the photosensitive drum 3 is exposed with a laser beam 7A, which is intensity-modulated in accordance with image data to be recorded, so that a latent image is formed on the surface of the photosensitive drum 3.

The latent image formed on the photosensitive drum 3 is guided to a developing area to be opposite to the developing unit 8 in accordance with the rotation of the drum 3.

The latent image guided to the developing area is selectively developed with toner charged at the predetermined polarity and the predetermined potential from a developing roller 43 of the developing unit 8.

More specifically, an outer peripheral surface of the developing roller 43 is coated with thin layer of toner T, which is one-component non-magnetic developer of frictional charging. Due to this, the outer peripheral surface of the photosensitive drum 3 is moved at a predetermined speed, toner T is supplied onto the latent image, which is already formed on the outer peripheral surface of the drum 3, from thin layer of toner T of the developing roller 43 in order. Toner T is adhered onto only the area which is exposed with laser beam 7A of the surface of the photosensitive drum 3.

The outer peripheral surface of the developing roller 43 is rotated in the same direction as the direction where the outer peripheral surface of the photosensitive drum 3 is rotated at the position where the outer peripheral surface of the developing roller 43 and the outer peripheral surface of the photosensitive drum 3 are opposite to each other (the rotational directions of the outer peripheral surface of the developing roller 43 and a shaft of the photosensitive drum 3 are opposite to each other).

The toner image TI formed on the photosensitive drum 3 where toner is received from the developing roller 43 is transferred to the transfer section 12.

On the other hand, sheet paper P is picked up from the sheet paper supply cassette 11 by the rotation of the sheet paper supply roller 15 to be sent to the transfer section 12 through the pair of the aligning rollers 16 are rotated to be synchronous with the rotation of the photosensitive drum 3.

In the transfer section 12, the rear face of sheet paper P matched with the toner image TI of the drum 3 is charged to have a plus polarity by the transfer roller 9. Thereby, the toner image TI formed on the surface of the photosensitive drum 3 is electrostatically attracted to sheet paper P to be transferred.

Toner T is melted and fixed to sheet paper P, to which toner image TI is transferred, by heat and pressure by the fixing unit 17.

Sheet papers P where the toner image TI is fixed is discharged to either the sheet paper receiving section 13 or the discharge tray 21. Normally, sheet paper P is discharged to the sheet paper receiving section 13.

After the toner image TI is moved to sheet paper P, a residual latent image is erased from the photosensitive drum 3 by the LED array 4. Sequentially, unnecessary materials such as residual toner after transferring and sheet paper dust are removed from the drum 3 by a cleaning blade 5A of the cleaning unit 5.

Thereafter, the same steps as the above-mentioned steps are repeated, and a plurality of images are output.

The following will explain the developing unit 8 in details with reference to FIGS. 2 to 7.

Figure 2:
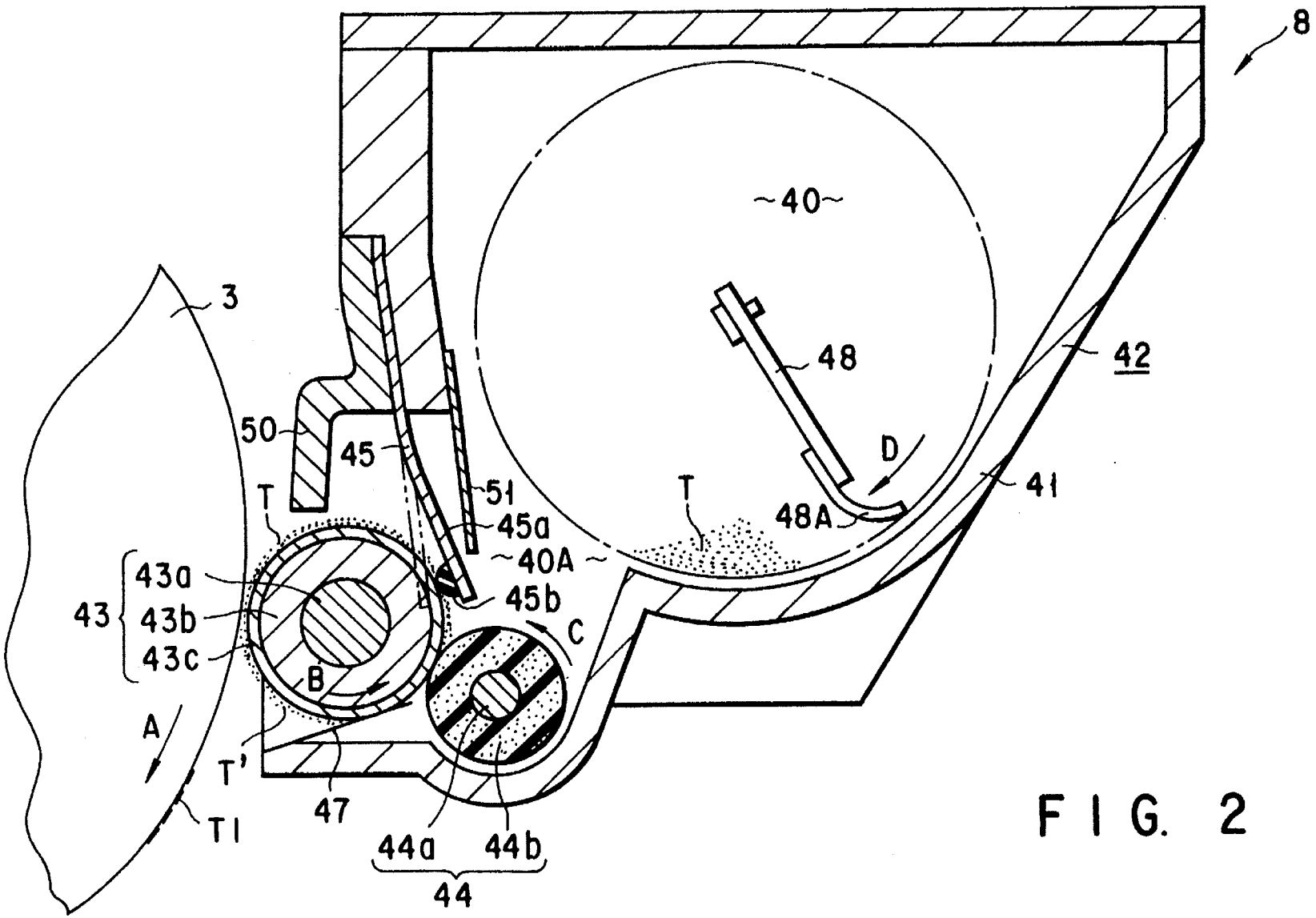
FIG. 2 is a schematic cross sectional view of a developing unit into which the image forming apparatus of FIG. 1 is incorporated.

FIG. 2 is a cross sectional view showing the entire structure of the developing unit 8.

The developing unit 8 includes a main body 42 of the developing unit in which a toner hopper 41 including a toner container 40 used as a developer containing section is formed as one unit.

The main body 42 of the developing unit has an opening at a position, which is opposite to the photosensitive drum 3. In the vicinity of the opening, a developing roller 43 is provided to be slightly bring into contact with the photosensitive drum 3. The developing roller 43 has elasticity, and is deformed when being brought into contact with the photosensitive drum 3. A length on the outer periphery of the developing roller 43 of an area, which is deformed when the the developing roller 43 is brought into contact with the photosensitive drum 3, is called as a nip width. The direction where the developing roller 43 is rotated is an opposite direction where the shaft of the photosensitive drum 3 is rotated in a state that an axis is used as a reference. In other words, the outer peripheral surface of the developing roller 43 and that of the photosensitive drum 3 are rotated in the same direction as the direction where the outer peripheral surface of the photosensitive drum 3 is rotated (arrow B) at the position where the outer peripheral surface of the developing roller 43 and that of the photosensitive drum 3 are rotated are opposite to each other.

At a position, which is opposite to the side where the developing roller 43 is exposed at the opening, and a portion corresponding to a bottom portion of the toner containing section 40, there is provided a toner supply roller 44 for supplying toner T to the developing roller 43.

The toner supply roller 44 supplies toner T from the toner containing section 40 to the developing roller 43, before the roller 43 is contacted with the photosensitive drum 3 and formed toner image TI on the drum 3. Also, the toner supply roller 44 is used to collect toner T' after developing the latent image of the photosensitive drum 3.

Moreover, there is provided a toner layer thickness restricting blade 45 at a portion, which is an upper portion of the developing roller 43, and a position before being brought into contact with the photosensitive drum 3. The toner layer thickness restricting blade 45 restricts an amount of toner, i.e., toner carrying amount, to be guided the photosensitive drum 3 through the developing roller 43, and for forming a thin layer of toner T on the surface of the developing roller 43.

At the lower surface side of the developing roller 43, there is provided a recovery blade 47 for receiving dropped toner by coming in contact with the developing roller 43.

In the toner containing section 40, there is provided a mixer 48 serving as mixing means for mixing toner of the toner containing section 40 to be preliminarily charged.

The following will explain a developing process for developing the latent image formed on the photosensitive drum 3 by the developing roller 43 (developing unit 8).

Toner T contained in the toner containing section 40 of the main body 42 of the developing unit 8 is sent to an area 40A of an upper portion of the toner supply roller 44 by a mixer 48 rotated in a direction of an arrow D. The mixer 48 is rotated such that a predetermined pressure can be provided to the direction of the developing roller 43. The pressure is set by a length of an arm portion 48A and a number of rotation of the mixer 48.

Therefore, in the area 40A, by flow of toner, which is pushed up by the toner supply roller 44 rotating in a dissection of an arrow C, and flow of toner, which is moved to the direction of the developing roller 43 by rotating the mixer 48, there is provided pressure, which can suitably control flow of toner directing from the toner supply roller 44 to the developing roller 43.

Toner T is further charged by friction between the toner supply roller 44 rotating in a direction of an arrow C and the developing roller 43 rotating in a direction of an arrow B. Moreover, a suitable bias potential (difference) is provided between the rollers 44 and 43, so that toner T is electrostatically absorbed onto the surface of the developing roller 43.

Sequentially, the toner transferring amount of toner T on the developing roller 43 is restricted by the toner layer thickness restricting blade 45. At the same time, the toner T is further charged to a potential, which is sufficient for development, by the friction between the developing roller 43 and the toner layer thickness restricting blade 45.

As mentioned above, toner T to which a predetermined potential is transferred to a position facing to the photosensitive drum 3. Then, toner T is adhered to the electrostatic latent image formed on the photosensitive drum 3, and formed toner image TI.

Moreover, residual toner, which is not contributed to development, is passed by the recovery blade 47, and returned to the main body 42 of the developing unit.

The developing roller 43 has an elastic layer 43*b* and a conductive surface layer 43*c*. The elastic layer 43*b* is formed on the outer periphery of a support 43*a*, formed of a metal shaft, to have conductivity. The conductive surface layer 43*c* is provided onto the surface of the elastic layer 43*b* to satisfy a surface smoothness.

The toner supply roller 44 includes a urethane foam layer 44*b*, which is formed on the outer periphery of a metal shaft 44*a* to have conductivity. The toner supply roller 44 comes in contact with the developing roller 43 with a predetermined pressure. The pressure can be expressed as a depth obtained when the toner supply roller 44 is dented by contacting the developing roller 43 and the toner Supply roller 44 each other. The depth is set to be about 0.2 to 1.0 mm. As mentioned above, the supply roller 44 is used to supply toner to the developing roller 43 and to remove the residual toner on the developing roller 43.

The toner layer thickness restricting blade 45 is attached to a part of the main body 42 of the developing unit 8 from a direction facing to the photosensitive drum 3 through a blade pressing plate 50. There is provided a developing blade vibration stopping member 51, which is formed of polyethylene terephthalate (trade name: Mylar, obtainable at Dupont), in a direction opposite to the blade pressing plate 50.

The toner layer thickness restricting blade 45 has a thin plate spring 45*a* formed of stainless steel (SUS) or bronze. In a case where the developing roller 43 is inserted to a predetermined position, the toner layer thickness restricting blade 45 is formed such that a linear load of 40 to 100 g/cm can be provided to the developing roller 43 by flexibility of the spring 45*a*.

The following will explain the toner layer thickness restricting blade 45 in more detail.

Figure 3:
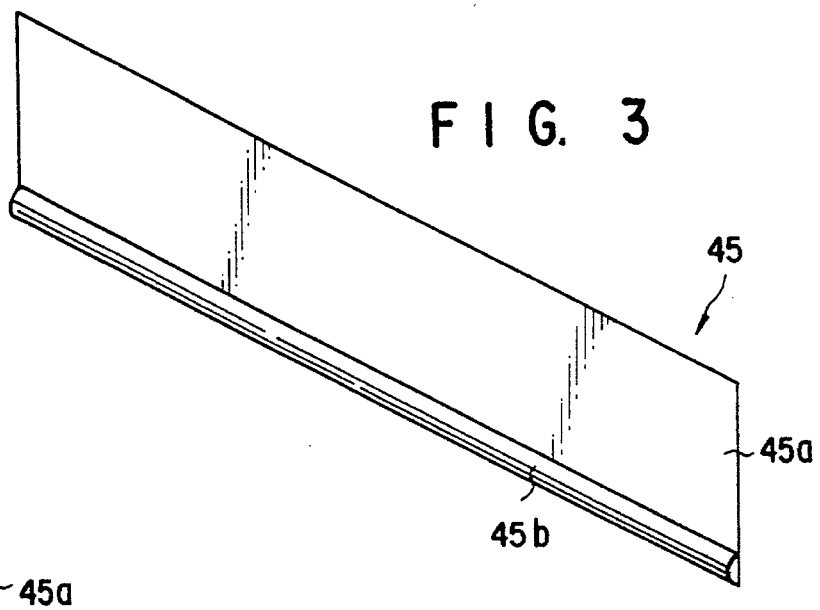
FIG. 3 is a schematic perspective view of a toner layer thickness restricting blade of the developing unit of FIG. 2.

FIG. 3 is a perspective view showing the feature of the shape of the toner layer thickness restricting blade 45.

In FIG. 3, the tone layer thickness restricting blade 45 has a projection 45*b* formed of elastic material such as silicon rubber to fulfill the width of the longitudinal direction of a free end of the thin plate spring 45*a*.

Figure 4:
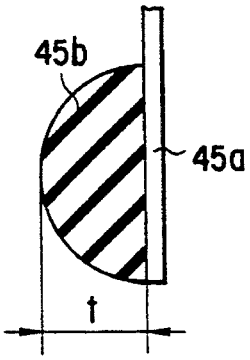
FIG. 4 is an enlarged view of a projection of the toner layer thickness restricting blade of the developing unit of FIG. 2.

FIG. 4 is a side view showing the shape of the projection 45*b* formed at a free end of the toner layer thickness restricting blade 45.

In FIG. 4, the projection 45*b* has a cross section of facing to the developing roller 43 is formed to be semicircular in order to concentrate an electrical charge generated by the friction on toner of the surface of the developing roller 43 without fail. Thereby, since the toner layer of the surface of the developing roller 43 is uniformly charged, so that the image developed on the drum becomes uniform.

Figure 5:
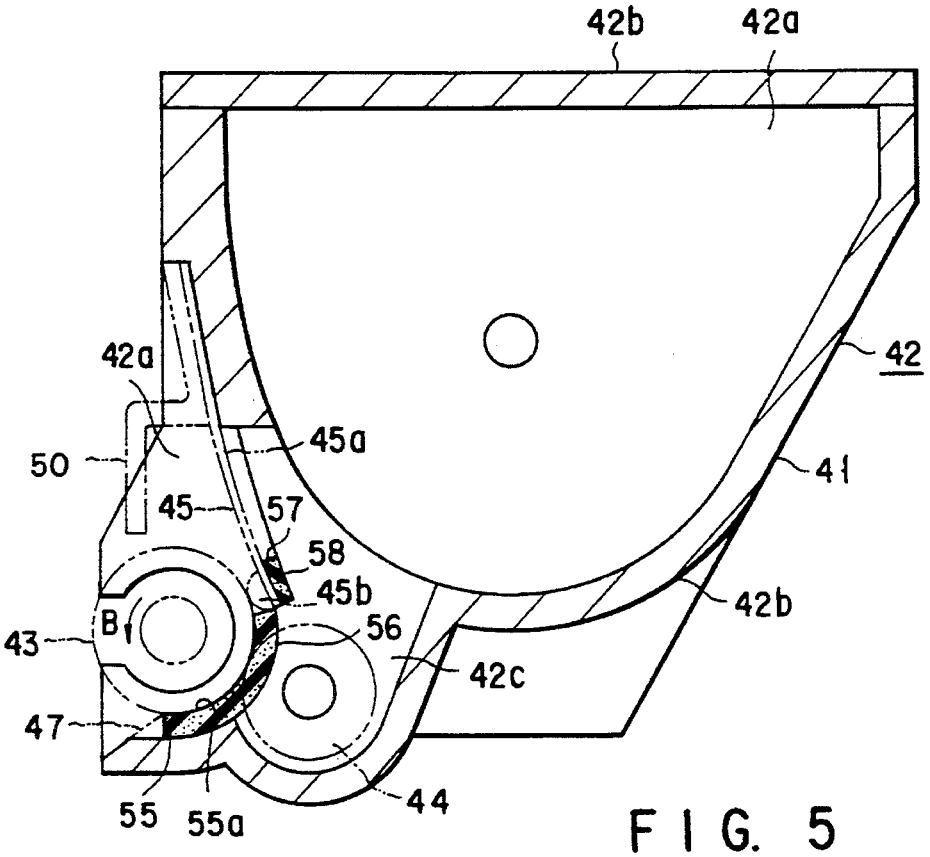
FIG. 5 is a schematic cross sectional view showing only a housing of the developing unit of FIG. 2 and sealing members.
Figure 6:
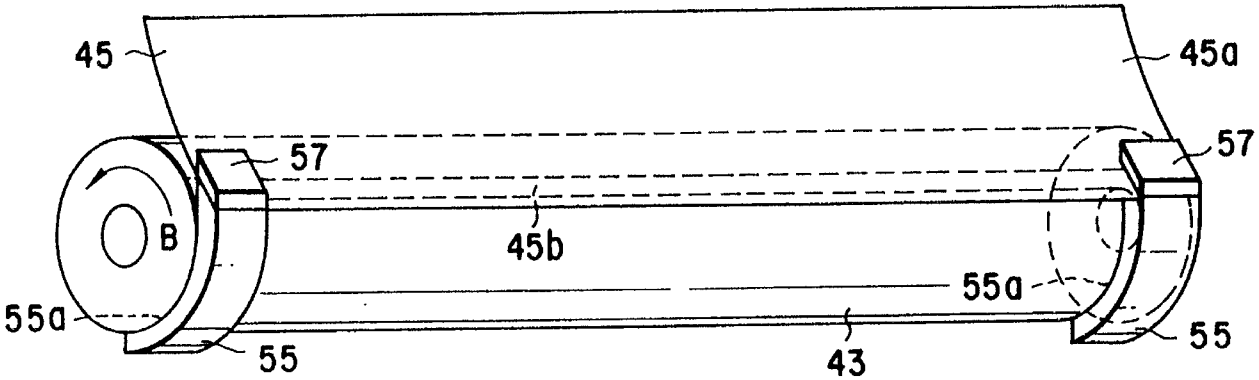
FIG. 6 is a schematic perspective view showing a relative position among the sealing members of FIG. 5, a toner layer thickness restricting blade, and a developing roller.
Figure 7:
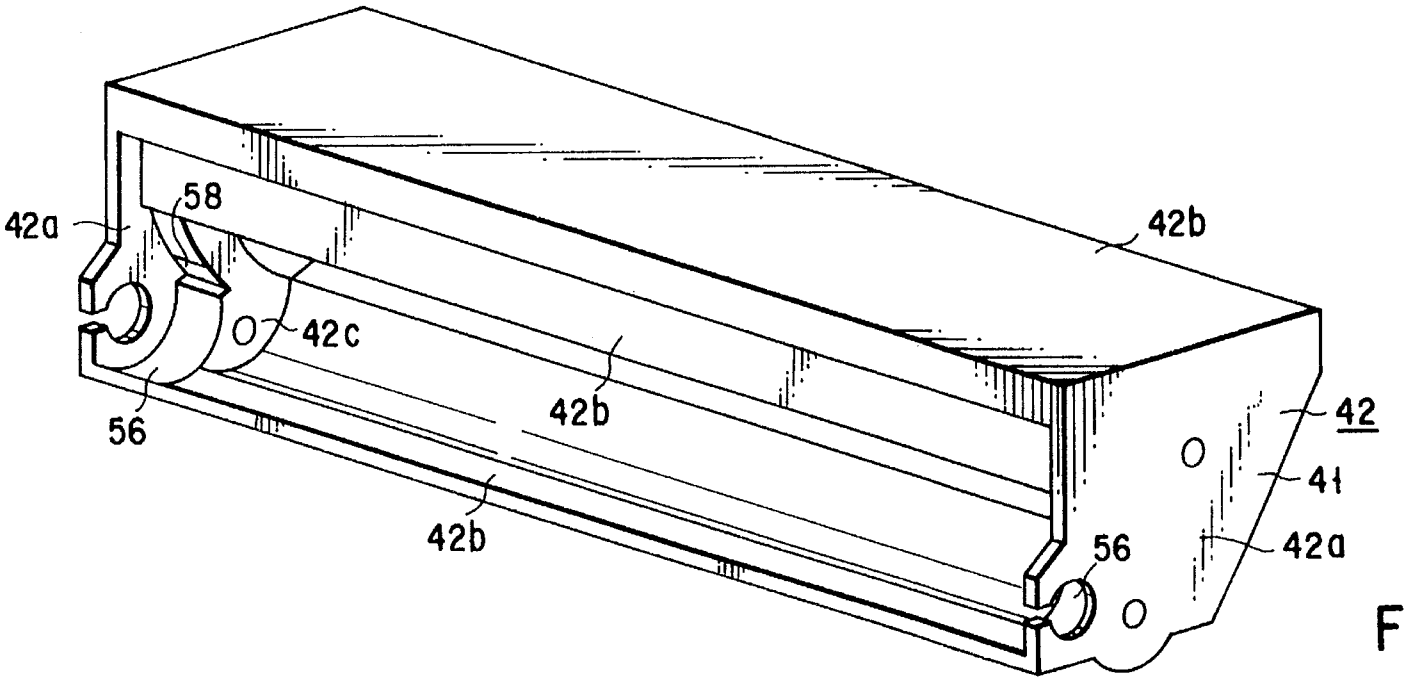
FIG. 7 is a schematic perspective view of the sealing members of FIG. 5 seen from the housing of the developing unit.

The following will explain the seal mechanism for preventing tones T from being leaked from both end portions of the longitudinal direction of the developing roller 43 of the developing unit 8 with reference to FIGS. 5 to 7.

FIG. 5 is a schematic cross sectional view showing only a housing of the developing unit of FIG. 2 and seal members, and FIG. 6 is a schematic cross sectional view showing the position of each of the developing roller 43, the toner layer thickness restricting blade 45, and the seal member of FIG. 5.

In FIGS. 5 and 6, a pair of first seal members are formed at a predetermined position of both end portions of the longitudinal direction of the the developing roller 43.

The first seal members 55 are formed at a position where the toner layer thickness restricting blade 45 and the outer peripheral surface of the developing roller 43 are contacted to each other, on the upper stream side of the position where the developing roller 43, when rotated, comes into contact with the projection 45*b* of the toner layer thickness restricting blade 45. In other words, the first seal members 55 contact the end of the projection 45*b* and are placed between the recovery blade 47 and the projection 45*b*.

Each of the first seal members 55 is formed to have a rectangular belt-shaped cross section. The first seal members 55 are formed, for example, from teflon felt.

The first seal members 55 are adhered to circular arc seal member adhering portions 56 facing to both ends of the position where the developing roller 43 is contained in the housing 42, respectively.

Thus, the first seal members 55 are adhered to the housing 42 which is shown in FIG. 7, and toner is prevented from entering between the developing roller 43 and the first seal members 55, even when the developing roller 43 is rotated.

The thickness of teflon felt (seal member) 55 is formed to be equal to or slightly larger than the size (height t of FIG. 4) of the projection 45*b*, and thicker than a gap between the developing roller 43 and each of the seal member adhering section 56. Therefore, a surface 55*a* of each of the first seal members 55 is pressurized to the outer periphery of both ends of the developing roller 43 by predetermined pressure.

The surface 55*a* is coated with, for example, lubricating fine grain such as polyvinylidene fluoride (trade name: KYNER301F, obtainable at Elf Atochem Japan), which is used in the cleaning blade.

A pair of second seal members 57 are formed at a predetermined position of the rear side of the both ends of the longitudinal direction of the toner layer thickness restricting blade 45 (surface opposite to the surface where the projection 45*b* is provided).

Each of the second seal members 57 is formed of an elastic material having a predetermined thickness such as urethane foam.

As shown in FIGS. 6 and 7, the second seal members 57 are adhered to seal member adhering sections 58 formed at both ends of the housing 42 and facing to the the containing section in which the toner layer thickness restricting blade 45 is contained, respectively.

The second seal members 57 are also used to press the blade 45 to the developing roller 43 by predetermined pressure. Each of the second seal members 57 have a thickness larger than a length between the housing 42 and the adhering sections 58 of the developing roller 43.

Moreover, the second seal members 57 prevent toner T from being leaked from both ends of the toner layer thickness restricting blade 45, and press the projection 45*b* of the blade 45 in a direction where the projection 45*b* comes in contact with the developing roller 43, so that the warp of the thin plate spring 45*a* or torsion can be reduced.

Whereby, the thickness of toner T (layer thickness), which is supplied to the surface of the developing roller 43 through the blade 45, and the amount of charging can be more stabilized.

It is noted that the second seal members 57 may be adhered to the toner layer thickness restricting blade 45.

FIG. 7 is a perspective view showing the shape of the main body (housing 42) of the developing unit 8.

As shown in FIG. 7, the housing 42 includes a pair of side surface portions 42*a*, longitudinal bottom portions 42*b*, and developer restricting surface portions 42*c*. The side surface portions 42*a* hold both ends of the longitudinal direction of the developing roller 43. The longitudinal bottom portions 42*b* are extended along the axis of the developing roller 43. Each of the developer restricting surface portions 42*c* is formed at a portion close to the center of the longitudinal direction of the developing roller 43 from each of the side surface portions 42*a* to have a predetermined length.

The first and second seal members 55 and 57 are adhered to developer restricting surface portions 42*c*, respectively. Whereby, the positions of the first and second seal members 55 and 57 can be easily designated. As a result of the developer restricting surface portions 42*c*, the time which is required for positioning can be reduced in assembling the developing unit 8.

Printout for 20,000 sheet papers of A4 size (developing unit driving test corresponding to printout for 20,000 sheet papers) was performed by use of the developing unit 8 having the above-mentioned seal structure. As a result, no leakage of toner T from the first seal members 55 was detected. Also, even if toner T is intentionally supplied to the non-image forming area of the surface of the developing roller 43, it was not confirmed that the toner image was developed onto the photosensitive drum 3.

Moreover, it was confirmed that substantially no heating was generated when the coefficient of friction was increased since toner T was not provided at both end portions of the developing roller 43 frictionally contacting the seal members 55. Regarding the above-mentioned results, it can be considered that lubricating fine grain such as polyvinylidene fluoride, which is used in the cleaning blade, is applied onto the surface 55*a* of each seal member, with the result that friction is sufficiently reduced. Also, the circumferential speed of the developing roller 43 was not changed by the friction between the seal members 55 and both ends of the developing roller 43.

Figure 8:
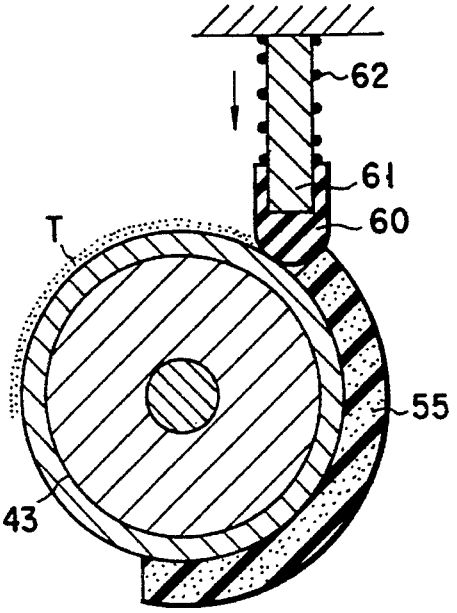
FIG. 8 is a schematic view showing a modification of sealing members of FIG. 5.
Figure 9:
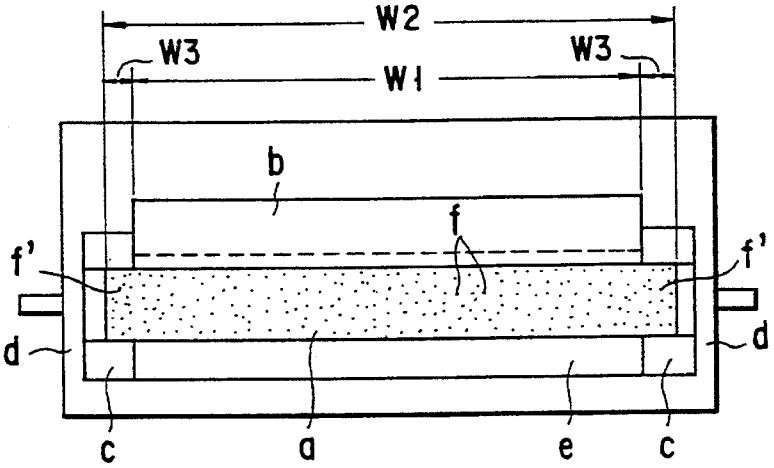
FIG. 9 (PRIOR ART)
FIGS. 9 and 10 are schematic views each showing an example of a conventional developing unit.
Figure 10:
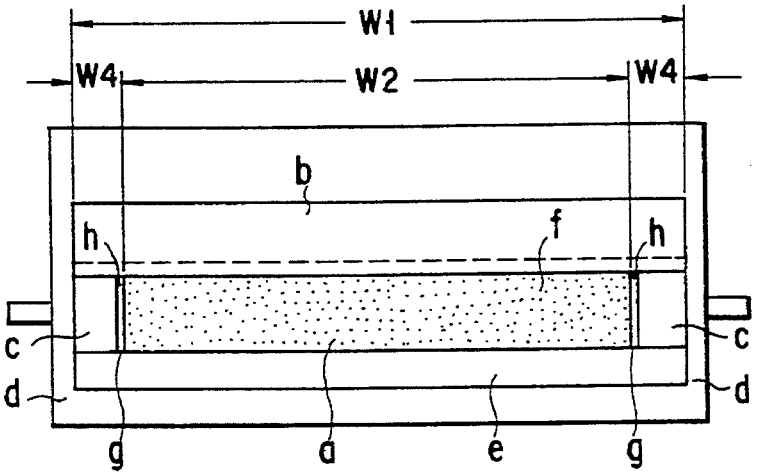
FIG. 10 (PRIOR ART)

FIG. 8 shows another embodiment of the toner layer thickness restricting blade 45, and is a cross sectional view of a direction which is perpendicular to the axial direction of the developing roller 43.

Referring to FIG. 8, a chip 60, which is formed of silicon rubber elastic material serving as a restricting member, is attached to a plurality of pins 61, (only one such pin 61 is shown in FIG. 8) serving as a support member, and pressed to the roller 43 by coil springs 62 so as to form the thin layer of toner T.

Various modifications can be made within the scope of the present invention without deviating from the description and examples disclosed herein.

As mentioned above, according to the developing unit of the present invention, the toner layer thickness restricting blade is formed to be the same as the width of the developing roller, and the seal members are provided to be pressurized to contact the semicircular section of the developing roller on the upper stream side of the developing roller rotating direction from the contact line of the toner layer thickness restricting blade. Thereby, toner can be prevented from being leaked to the surface of the developing roller of the non-image area, undesirable image can be prevented from being developed onto the photosensitive drum, and the toner consumption amount and toner collecting amount can be reduced.

Moreover, according to the developing unit of the present invention, the frictional resistance between the first seal members and the developing roller is reduced, and heating caused by the developing roller or the rotational speed of the developing roller can be prevented.

Furthermore, according to the developing unit of the present invention, the second seals are set to the rear surface of both end portions. Thereby, predetermined pressure is applied to the toner layer thickness restricting blade. At the same time, toner can be prevented from being leaked to the end portion of the developing roller.

Therefore, both end portions of the toner layer thickness restricting blade can be correctly brought into contact with the developing roller without having influence of the warp of the toner layer thickness restricting blade or torsion, and the stable toner layer can be formed.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A developing unit for developing a latent image formed on an image carrier by contacting a thin layer of toner, said developing unit comprising:

a housing member having a developer containing section for containing toner;

a toner conveying roller, rotatably provided in said housing member to face a developing area of the image carrier, for conveying toner to said developing area;

a toner layer thickness determining member, having a toner layer thickness determining plate having a length which is the same as the length of said toner conveying roller, for forming a toner layer having a predetermined thickness on said toner conveying roller by pressurizing said toner thickness determining plate onto a surface of said toner conveying roller; and a pair of first sealing members longitudinally arranged on a cylindrical portion of both ends of said toner conveying roller along an outer peripheral surface of said toner conveying roller such that a gap is set between said first sealing members and said toner layer thickness determining member in a frictional state, each of said first sealing members having a thickness greater than a gap between said toner conveying roller and respective first adhering sections of said housing member, and each of said first sealing members being respectively arranged between said first adhering sections of said housing member and said toner conveying roller to thereby apply a predetermined pressure to said toner conveying roller; and wherein said toner layer thickness determining member further includes:

at least one pin extended to said toner conveying roller;

an elastic member bridged over said at least one pin; and urging members urging said elastic member to said toner conveying roller;

said elastic member and said urging members being provided at a position where said at least one pin and said toner conveying roller face each other.

2. A developing unit for developing a latent image formed on an image carrier by contacting a thin layer of toner, said developing unit comprising:

a housing member having a developer containing section for containing toner;

a toner conveying roller, rotatably provided in said housing member to face a developing area of the image carrier, for conveying toner to said developing area;

a toner layer thickness determining member, having a toner layer thickness determining elastic member having a length which is the same as the length of said toner conveying roller, for forming a toner layer having a predetermined thickness on said toner conveying roller by pressurizing said toner thickness determining elastic member onto a surface of said toner conveying roller; and a pair of semicircular first sealing members longitudinally arranged on a cylindrical portion of both ends of said toner conveying roller along an outer peripheral surface of said toner conveying roller such that a gap is set between said first sealing members and said toner layer thickness determining member in a frictional state; and wherein said toner layer thickness determining member further includes at least one pin extended to said toner conveying roller, said elastic member being bridged over said at least one pin, and urging members urging said elastic member to said toner conveying roller, each of said elastic member and said urging members being provided at a position where said at least one pin and said toner conveying roller face each other.

3. The developing unit according to claim 2, wherein each of said first sealing members is positioned at an upstream side of said toner layer thickness determining member along a direction in which said toner conveying roller is rotatable.

4. The developing unit according to claim 2, wherein said first sealing members include lubricating fine grains.

5. The developing unit according to claim 4, wherein a surface of each of said first sealing members is coated with lubricating fine grains.

6. The developing unit according to claim 2, further comprising:

a pair of second sealing members each of which is provided in the vicinity of a position where said toner layer thickness determining member faces said toner conveying roller at a side opposite to a side facing said toner conveying roller, each of said second sealing members being arranged at respective second adhering sections of said housing member.

7. The developing unit according to claim 6, wherein each of said second sealing members has a thickness greater than or equal to a gap between said respective second adhering sections of said housing member and said toner conveying roller.

8. The developing unit according to claim 6, wherein said second sealing members apply a predetermined pressure to said toner conveying roller and said toner layer thickness determining member, respectively.

9. The developing unit according to claim 6, wherein said second sealing members include lubricating fine grains.

10. The developing unit according to claim 9, wherein a surface of each of said first sealing members and said second sealing members is coated with lubricating fine grains.

* * * * *